US008109182B2

(12) United States Patent
Chen

(10) Patent No.: US 8,109,182 B2
(45) Date of Patent: Feb. 7, 2012

(54) RATCHET TOOL

(75) Inventor: Ho-Yi Chen, Wuci Township, Taichung County (TW)

(73) Assignees: Tsung-Te Lin, Taichung (TW); Ming-Ang Yang, Taichung (TW)

( * ) Notice: Subject to any disclaimer, the term of this patent is extended or adjusted under 35 U.S.C. 154(b) by 327 days.

(21) Appl. No.: 12/512,872

(22) Filed: Jul. 30, 2009

(65) Prior Publication Data

US 2011/0023664 A1 Feb. 3, 2011

(51) Int. Cl.
*B25B 13/46* (2006.01)

(52) U.S. Cl. ..... 81/63.1; 81/62

(58) Field of Classification Search ..... 81/61, 62, 81/63.1

See application file for complete search history.

(56) References Cited

U.S. PATENT DOCUMENTS

| | | | | |
|---|---|---|---|---|
| 3,587,364 | A * | 6/1971 | Peyre | 81/61 |
| 6,311,584 | B1 * | 11/2001 | Chu | 81/62 |
| 6,976,409 | B2 * | 12/2005 | Shu | 81/62 |
| 7,536,934 | B1 * | 5/2009 | Tatangelo | 81/60 |
| 2011/0113933 | A1 * | 5/2011 | Lee | 81/63.1 |

* cited by examiner

*Primary Examiner* — Debra S Meislin
(74) *Attorney, Agent, or Firm* — Egbert Law Offices PLLC

(57) ABSTRACT

The present invention provides a ratchet tool, wherein a circular tooth row is arranged into the round groove of the main body's actuating end. A tool driving seat is assembled rotatably onto the round groove of the main body. A first braking slot, a second braking slot and an arched control slot are triangularly configured onto the internal surface of the tool driving seat. The first and second braking slots are separately fitted with the first and second braking swing blocks. A moveable control gear is placed into the control slot and can shift to the through-hole at both ends of the control slot such that it is mated simultaneously with inner tip edges of the first and second braking swing blocks. An elastic resetter is additionally provided to make the first and second braking swing blocks with inner tip edge swing inwards in a normal state.

7 Claims, 5 Drawing Sheets

RATCHET TOOL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a handheld tool, and more particularly to an innovative tool which is a ratchet.

2. Description of Related Art Including Information Disclosed Under 37 CFR 1.97 and 37 CFR 1.98

With the elastic support of the elastic parts and position switching of the switching parts, the conventional ratchet tool enables the unidirectional latched block or snap gauge to be snapped (or articulated) along the preset rotational direction, or otherwise rotated reversely in an idle state. Yet, there are shortcomings for the typical ratchet tool are observed during actual application.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

Based on the unique structure of the present invention that a first braking slot, a second braking slot and an arched control slot are triangularly configured onto the internal surface of the tool driving seat, two braking slots are separately fitted with the first and second braking swing blocks. A moveable control gear is placed into the control slot, and an elastic resetter is additionally provided to make the first and second braking swing blocks swing inwards in a normal state. The frictional resistance of the ratchet tool of the present invention can be minimized under an idle state, thus preventing interlocking of the bolts and nuts, and improving substantially the working efficiency with better convenience and applicability.

DETAILED DESCRIPTION OF THE INVENTION

Figure 1:
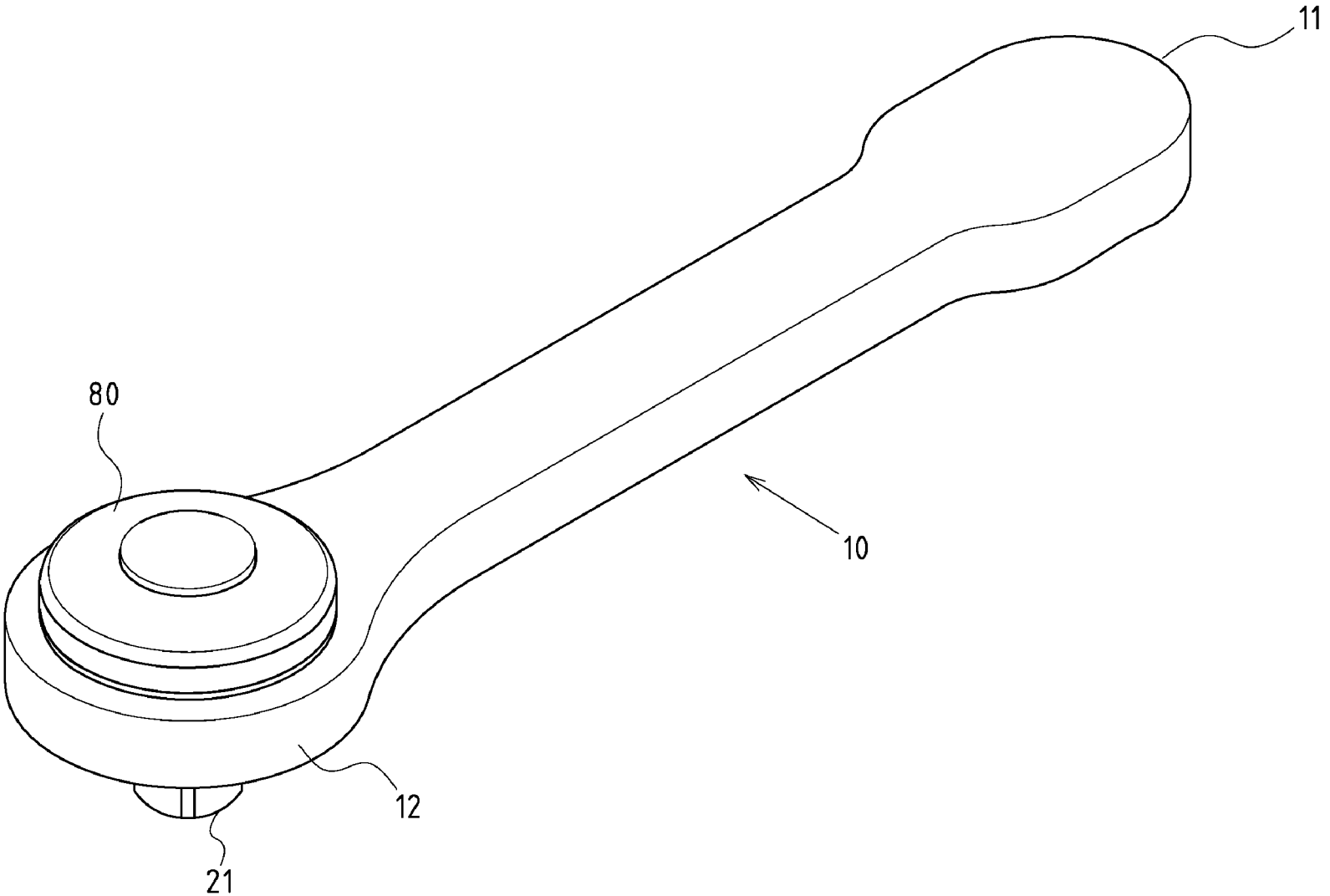
FIG. 1 shows an assembled perspective view of the preferred embodiment of the ratchet tool of the present invention.
Figure 2:
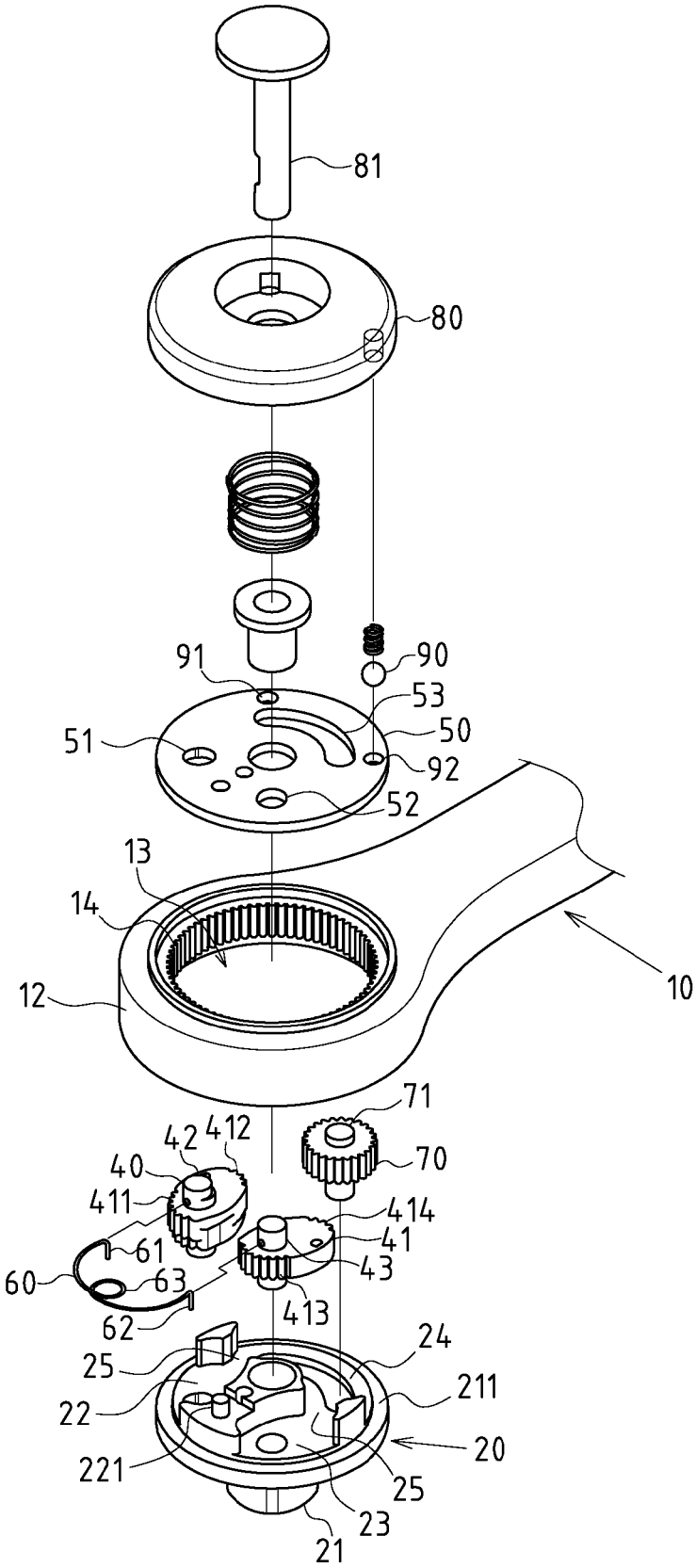
FIG. 2 shows an exploded perspective view of the preferred embodiment of the ratchet tool of the present invention.
Figure 3:
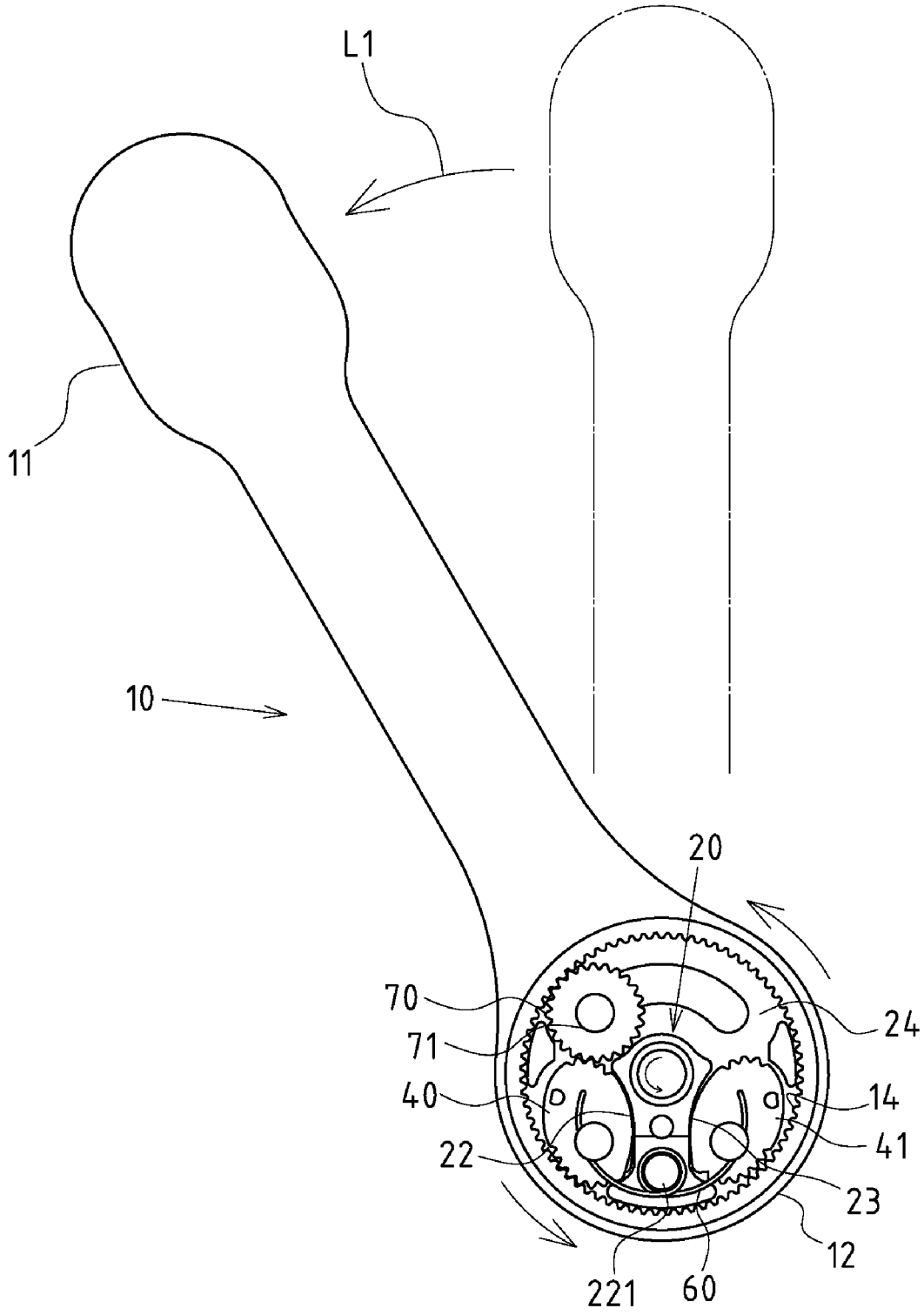
FIG. 3 shows a schematic view of the ratchet tool of the present invention actuating.

FIGS. 1-3 depict preferred embodiments of a ratchet tool of the present invention, which, however, are provided for only explanatory objectives with respect to the patent claims. The ratchet tool of the preferred embodiment refers to a ratchet spanner. There is a main body 10, including a handle 11 and an actuating end 12 (a quadrangular rod). The actuating end 12 is provided with a round groove 13. A circular tooth row 14 is arranged on the inner periphery of the round groove 13.

There is a tool driving seat 20, assembled rotatably onto one side of the round groove 13 of the main body 10. A tool driving portion 21 is placed at external end of the tool driving seat 20, and the internal end of the tool driving seat 20 faces the round groove 13.

A first braking slot 22, a second braking slot 23 and a control slot 24 are triangularly configured onto the internal surface 211 of the tool driving seat. The first and second braking slots 22, 23 are arranged at intervals, with external openings connected with the circular tooth row 14. The control slot 24 is an arced space in tune with the circular tooth row 14. A through-hole 25 at both ends of the control slot 24 is separately connected to the first and second braking slot 22, 23. The exterior of the control slot 24 is open-ended and connected with the circular tooth row 14.

A first braking swing block 40 is placed into the first braking slot 22. An outer tip edge 411 and an inner tip edge 412 are arranged laterally onto the first braking swing block 40. The outer tip edge 411 faces the external opening of the first braking slot 22 corresponding to the circular tooth row 14. The inner tip edge 412 faces the through-hole 25 corresponding to the control slot 24. Moreover, the first braking swing block 40 is provided with a first pivoted portion 42, so that the first braking swing block 40 can swing by taking the first pivoted portion 42 as a pivot.

A second braking swing block 41 is placed into the second braking slot 23. An outer tip edge 413 and an inner tip edge 414 are arranged laterally onto the second braking swing block 41. The outer tip edge 413 faces the external opening of the second braking slot 23 corresponding to the circular tooth row 14. The inner tip edge 414 faces the through-hole 25 corresponding to the control slot 24. Moreover, the second braking swing block 23 is provided with a second pivoted portion 43, so that the second braking swing block 23 can swing by taking the second pivoted portion 43 as a pivot.

An elastic resetter 60 is assembled between the first braking swing block 40 and second braking swing block 41, and used to drive the ends of the first/second braking swing blocks 40, 41 with inner tip edges 412, 414 to swing inwards in a normal state. The elastic resetter 60 of the preferred embodiment is a U-shaped torsional spring, which comprises a first elastic pin 61, a second elastic pin 62 and a locating collar 63 at the central section. At the spacing between the first braking slot 22 and second braking slot 23, a locating column 221 is protruded for sleeving of the locating collar of the elastic resetter 60. At the ends of the first/second braking swing blocks 40, 41 with inner tip edges 412, 414, the first and second insertion holes are arranged separately for embedding and positioning of the first/second elastic pins 61, 62 of the elastic resetter 60.

A moveable control gear 70 is placed into the control slot 24 in a moveable state. One side of the moveable control gear 70 is normally mated with the circular tooth row 14. When the moveable control gear 70 shifts to the through-hole 25 at both ends of the control slot 24, it is mated simultaneously with the inner tip edges 412, 414 of the first braking swing block 40 or the second braking swing block 41. Moreover, the moveable control gear 70 is fitted with a brake rod 71 protruding out of the control slot 24.

The invention includes a cover 50, covered onto one side of the round groove 13 of the tool driving seat 20 so as to conceal the parts within the aforementioned round groove 13. The cover 50 is provided with an arched hole 53 for the penetration of the brake rod 71 of the moveable control gear 70.

The first pivoted portion 42 of the first braking swing block 40 and the second pivoted portion 43 of the second braking swing block 41 can be arranged in an offset state nearby the outer tip edges 411, 413.

The first pivoted portion 42 of the first braking swing block 40 and the second pivoted portion 43 of the second braking swing block 41 can be designed into a flanged shaft. The cover 50 is provided with a first axle hole 51 for insertion and limitation of the first pivoted portion 42 of the first braking swing block 40, or provided with a second axle hole 52 for insertion and limitation of the second pivoted portion 43 of the second braking swing block 41.

The first and second axle holes 51, 52 of the cover 50 can be designed into elongated holes, which are extended linearly through the first/second axle holes 51, 52 from the central point of the cover 50, so that the first and second braking swing blocks 40, 41 can also generate slight offset for more tight mating of the outer tip edges 411, 413 with the circular tooth row 14.

A rotary table 80 is mounted at the exterior of the cover 50. The center of the rotary table 80 is assembled onto the cover 50 via a supported spindle 81. The protruding end of the brake rod 71 of the moveable control gear 70 is connected eccentrically to the rotary table 80, so that the brake rod 71 can shift under the drive of the rotary table 80. Furthermore, an elastic bead 90 and two spaced snapping edges 91, 92 are arranged on the assembly surface of the rotary table 80 and the cover 50, so that the positive and reverse rotation angles of the rotary table 80 can be positioned by snapping the elastic bead 90 into either of the snapping edge 91 or 92.

Based upon above-specified structures, the present invention is operated as follows:

Referring to FIG. 2, the ratchet tool of the preferred embodiment can be used in such a way that the rotary table 80 is rotated positively or reversely to drive the brake rod 71, so as to switch the shift direction of the moveable control gear 70 on the control slot 24, and further control the driving direction of the main body 10 for the tool driving seat 20 (i.e. positive or reverse driving mode).

Figure 4:
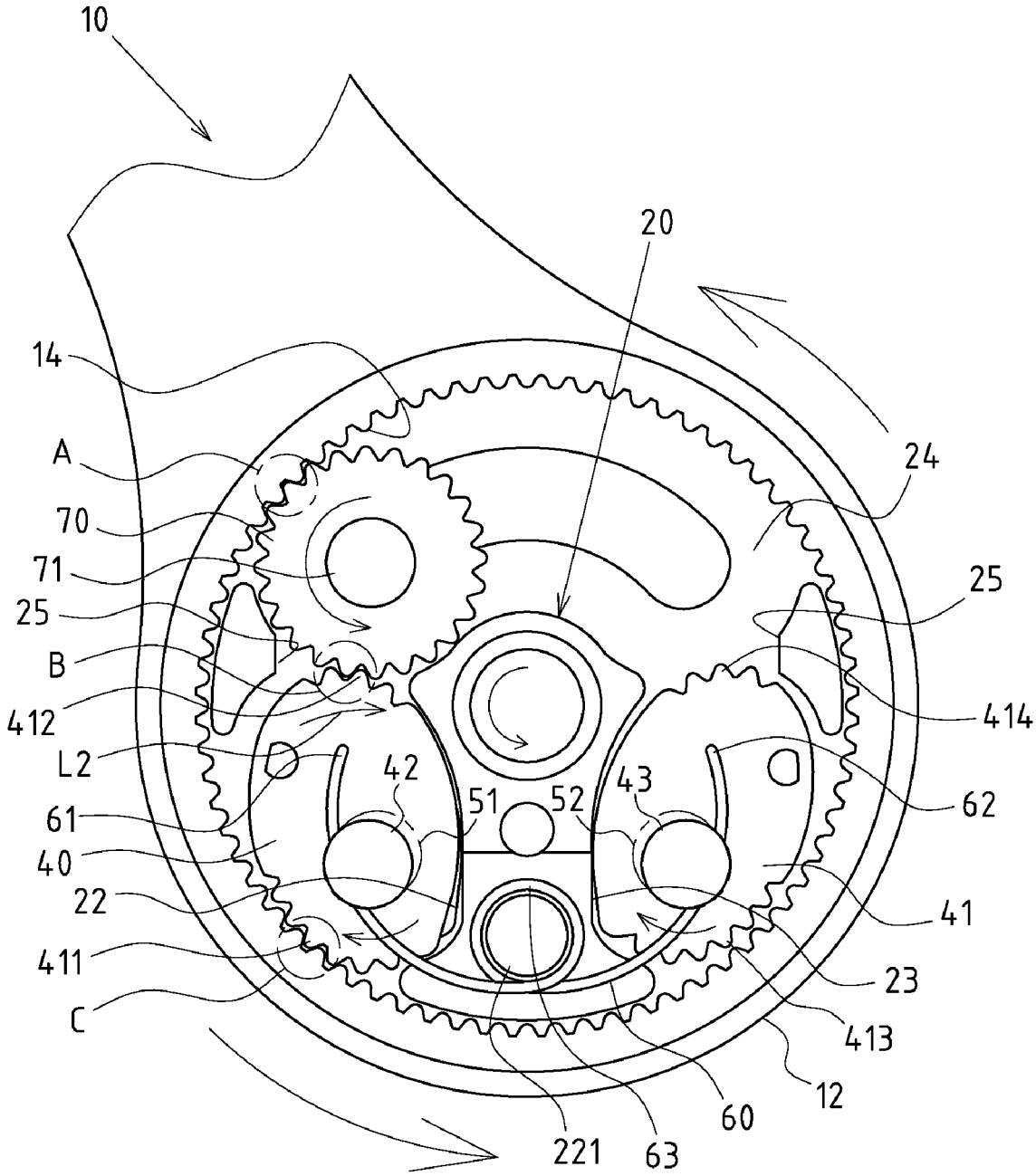
FIG. 4 shows a partially enlarged schematic view of FIG. 3.

Referring to FIGS. 3 and 4, when the moveable control gear 70 is located at a left-hand through-hole 25 of the control slot 24, the present invention is under a reverse driving mode. Namely, when the main body 10 is reversely turned (shown by arrow L1 in FIG. 3), the moveable control gear 70 is mated with the circular tooth row 14 (e.g. position A) in a reverse rotation state, and then mated with the inner tip edge 412 (e.g. position B) to drive the first braking swing block 40 to swing positively by taking the first pivoted portion 42 as a pivot (shown by arrow L2 in FIG. 4). Furthermore, the outer tip edge 411 of the first braking swing block 40 is mated with the circular tooth row 14 (e.g. position C). Owing to the mating state of positions A, B, C, the circular tooth row 14 and the moveable control gear 70 cannot rotate continuously, but are connected permanently so that the tool driving seat 20 will be rotated along with the circular tooth row 14 of the main body 10.

Figure 5:
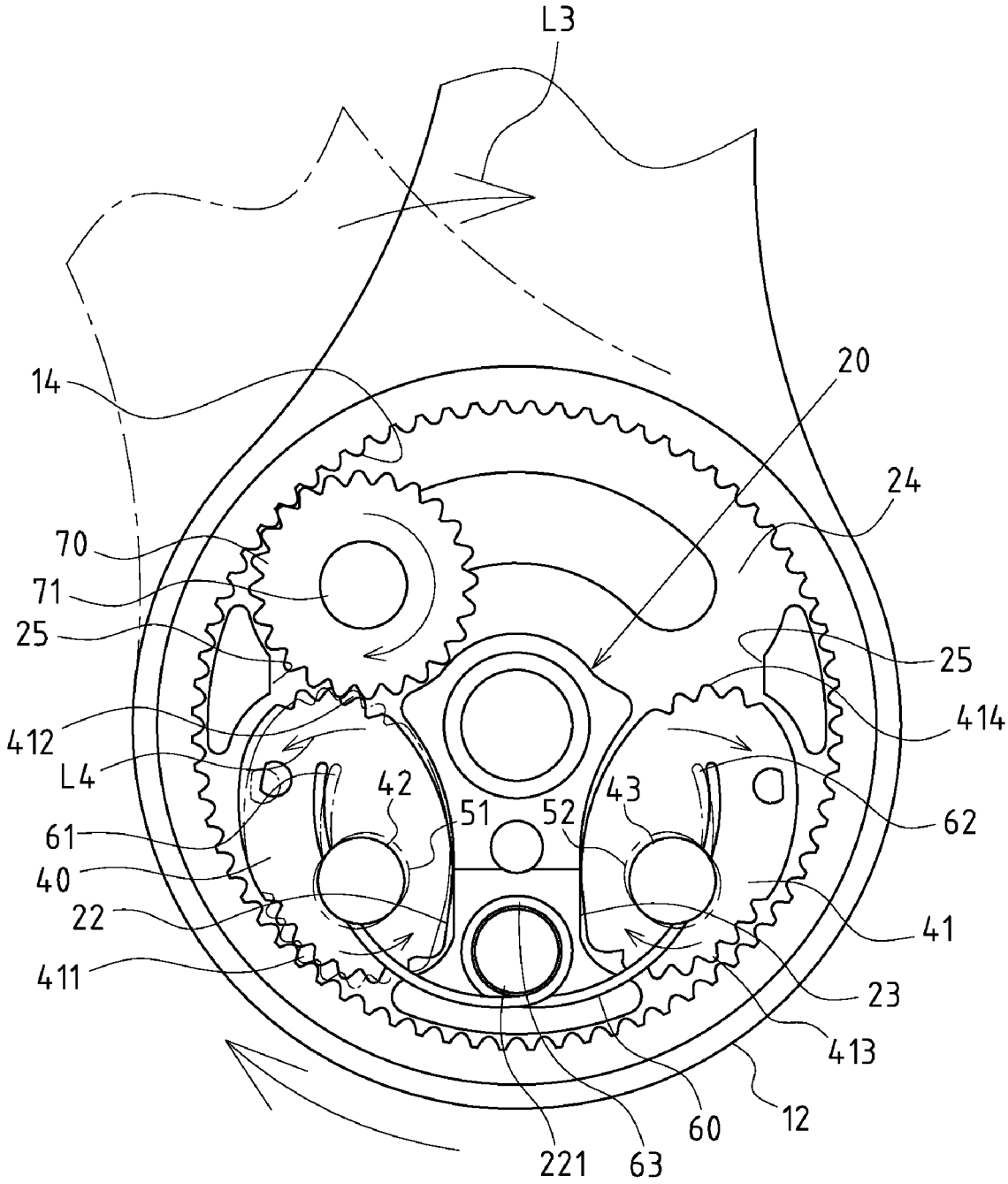
FIG. 5 shows another schematic view of the ratchet tool of the present invention actuating.

Referring also to FIG. 5, when the main body 10 is positively turned (shown by arrow L3), the circular tooth row 14 and the moveable control gear 70 are rotated simultaneously, and the inner tip edge 412 is mated to drive the first braking swing block 40 to rotate by taking the first pivoted portion 42 as a pivot (shown by arrow L4), so the outer tip edge 411 of the first braking swing block 40 is disengaged from the circular tooth row 14. Since the circular tooth row 14 is only mated with the moveable control gear 70 and able of rotating continuously, the tool driving seat 20 is under an idle state while it cannot be driven by the circular tooth row 14 of the main body 10. In such a state, the inner tip edge 412 of the first braking swing block 40 can be elastically reset inwards with the assembly of the elastic resetter 60, so when the moveable control gear 70 is positively rotated to continuously mate with the inner tip edge 412 and bring about the reverse swinging of the first braking swing block 40, the snapping effect will be yielded from the elastic resetting action.

When the ratchet tool of the present invention is under an idle state, the frictional resistance is generated only through the elastic snapping position between the moveable control gear 70 and the inner tip edges 412 of the first braking swing block 40, so the tiny resistance permits to realize excellent idle state.

When the ratchet tool of the present invention is under a positive driving state, the moveable control gear 70 is switched to the right-hand through-hole 25 of the control slot 24 in the same manner.

I claim:

1. A ratchet tool comprising:

a main body having a handle and an actuating end, said actuating end having a round groove with a circular tooth row formed on an inner periphery of said round groove;

a tool driving seat rotatably mounted onto one side of said round groove, said tool driving seat having a tool driving portion at an external end thereof, said tool driving seat having an internal end facing said round groove, said tool driving seat having a first braking slot and a second braking slot and a control slot triangularly configured onto an internal surface of said tool driving seat, said first braking slot being in spaced relation to said second braking slot, said control slot being an arc aligned with said circular tooth row, said control slot having a through-hole opening at opposite ends thereof, said through-hole separately connected to said first and second braking slots, said control slot having an open-ended exterior that is connected with said circular tooth row;

a first braking swing block positioned in said first braking slot, said first braking swing block having an outer tip edge and an inner tip edge arranged laterally thereon, said outer tip edge facing an external opening of said first braking slot corresponding to said circular tooth row, said inner tip edge facing said through-hole corresponding to said control slot, said first braking swing block having a first pivoted portion about which said first braking swing block swings;

a second braking swing block positioned into said second braking slot, said second braking swing block having an outer tip edge and an inner tip edge arranged laterally thereon, said outer tip edge of said second braking swing block facing an external opening of said second braking slot corresponding to said circular tooth row, said inner tip edge of said second braking swing block having a second pivoted portion about which said second braking swing block can swing;

an elastic resetter assembled between said first and second braking swing blocks, said elastic resetter suitable for driving ends of said first and second braking swing blocks such that the inner tip edges thereof swing inward in a normal state;

a movable control gear movably positioned in said control slot, said movable control gear having one side mated with said circular tooth row, said movable control gear shiftable to said through-hole so as to simultaneously mate with the inner tip edge of said first or second braking swing blocks and said circular tooth row, said movable control gear having a brake rod protruding outwardly of said control slot; and a cover covering one side of said round groove of said tool driving seat, said cover having an arched hole through which said brake rod extends.

2. The ratchet tool of claim 1, said elastic resetter comprising a first elastic pin and a second elastic pin and a locating collar at an central section, said first and second braking slots having a location column in a space therebetween, said locating collar sleeving over said locating column, said first and second braking swing blocks having first and second insertion holes at ends thereof, said first and second elastic pins embedded respectively in said first and second insertion holes.

3. The ratchet tool of claim 1, said first pivoted portion and said second pivoted portion arranged in offset relationship adjacent the outer tip edges.

4. The ratchet tool of claim 1, said first pivoted portion and said second pivoted portion arranged on a flanged shaft, said cover having a first axle hole receiving said first pivoted portion.

5. The ratchet tool of claim 4, said first axle hole being an elongated hole.

6. The ratchet tool of claim 1, further comprising:

a rotary table mounted at an exterior of said cover, said rotary table having a center assembled onto said cover by a spindle, said brake rod having a protruding end connected eccentrically to said rotary table.

7. The ratchet tool of claim 6, said rotary table and said cover having an elastic bead and a pair of spaced snapping edges thereon.

* * * * *